US006863175B2

(12) United States Patent
Gelardi

(10) Patent No.: US 6,863,175 B2
(45) Date of Patent: Mar. 8, 2005

(54) LOCKING CONTAINER

(75) Inventor: John A. Gelardi, Kennebunkport, ME (US)

(73) Assignee: MeadWestvaco Corporation, Stamford, CT (US)

( * ) Notice: Subject to any disclaimer, the term of this patent is extended or adjusted under 35 U.S.C. 154(b) by 153 days.

(21) Appl. No.: 10/118,023

(22) Filed: Apr. 9, 2002

(65) Prior Publication Data

US 2003/0015438 A1 Jan. 23, 2003

Related U.S. Application Data

(60) Provisional application No. 60/305,851, filed on Jul. 18, 2001.

(51) Int. Cl.[7] ..... A45C 13/10

(52) U.S. Cl. ..... 206/1.5; 206/531; 206/538

(58) Field of Search ..... 206/1.5, 528, 531, 206/532, 534.1, 534.2, 536, 538, 464–469

(56) References Cited

U.S. PATENT DOCUMENTS 4,048,051 A 9/1977 Gretz
4,120,400 A 10/1978 Kotyuk
4,174,034 A * 11/1979 Hoo ..... 206/1.5
4,192,422 A 3/1980 Kotyuk
4,219,116 A 8/1980 Borkan
4,511,032 A 4/1985 Bush
4,561,544 A 12/1985 Reeve
4,730,731 A 3/1988 Allison
4,890,742 A 1/1990 Allison
5,080,222 A 1/1992 McNary
5,082,137 A 1/1992 Weinstein
5,129,527 A 7/1992 Lataix
5,180,072 A 1/1993 Oehlert
5,275,291 A 1/1994 Sledge
5,740,938 A 4/1998 Hofmann et al.
6,021,901 A 2/2000 Wolfe
6,349,831 B1 * 2/2002 Buss ..... 206/531
6,460,693 B1 * 10/2002 Harrold ..... 206/1.5
6,510,960 B1 * 1/2003 Christopherson et al. ..... 220/345.3

* cited by examiner

*Primary Examiner*—Jila M. Mohandesi

(57) ABSTRACT

A locking container has a tray with sidewalls, a shelf and a bottom with an elongated opening. A sliding lock and a spring are formed in the bottom opening. A lock flap is hinged to the shelf. A cover has a base glued to the tray bottom, a spine end and a top panel. A latch extension extends form the flap through holes in the shelf and top panel. Sliding the lock with a finger or thumb and lifting with fingers both side sections of the flap releases the latch extension and allows raising of the top panel. Articles are held in bubbles of an inner laminate on the panel.

37 Claims, 19 Drawing Sheets

FIG. 7
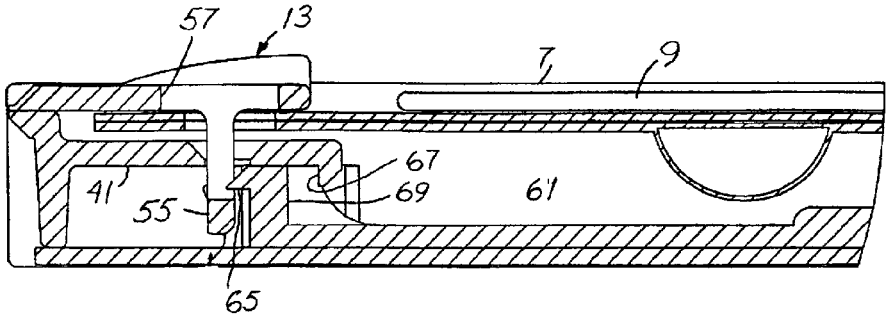
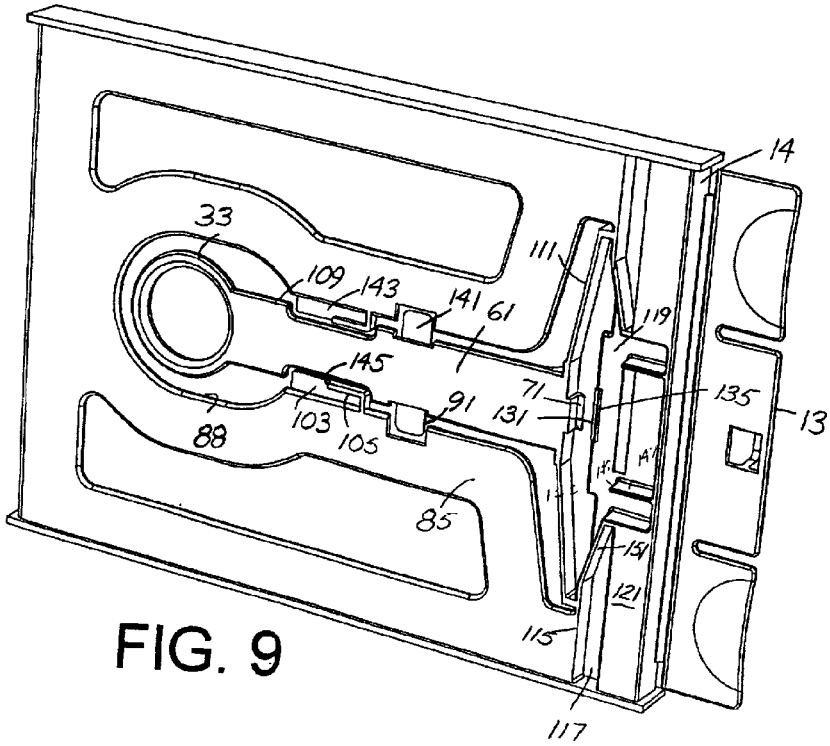
FIG. 9

LOCKING CONTAINER

This application claims the benefit of U.S. Provisional Application No. 60/305,851, filed Jul. 18, 2001.

BACKGROUND OF THE INVENTION

Locking containers, especially childproof locking containers, in which multiple movements must be applied to open the container, have many uses. One use for locking containers is medicine containers. Locking caps on medicine bottles are well known. The caps usually require axial pressure or inward radial squeezing while turning the caps to remove the caps from the containers and to provide access to medicine therein.

Many medicines are packaged in flat boxes, which are difficult to secure with childproof locks. Needs exist for flat boxes that have locks which require multiple motions for opening. Needs exist for inexpensive locking boxes.

SUMMARY OF THE INVENTION

The invention provides a locking container. In a preferred form of the invention the locking container is flat and has one element, which provides a form and a lock, and a second element, which provides an enclosure. Preferably the enclosure also includes a carrier for the protected contents of the container. In one embodiment of the invention, the container has a rigid tray and an outer covering which encloses the tray. A slide connected to the tray releases a lock, which secures the cover to the tray while the slide is in the locked position. When the slide is moved to an unlocked position, the lock may be opened to release the cover, so that the cover may be moved with respect to the tray. Preferably the lock locks one end portion of the cover. The other end portion of the cover is hinged to the tray. Lateral sides of the cover are held beneath the inward projections on upward extended sides of the tray.

In one preferred embodiment of the invention, the tray is rectangular and has a central main body, rectangular opposite sidewalls and rectangular opposite end walls. Preferably, the cover is a paperboard or plastic material, which is formed in three parts by providing two parallel creases. A base panel underlies the tray and is glued or otherwise connected to the bottom of the tray. A spine panel overlies an end of the tray, and a cover panel overlies the top of the tray. The cover panel may be folded at a free end and laminated to provide a relatively rigid cover. Alternatively, a second layer may be laminated on the inside of the cover panel to provide rigidity and also to provide holders for the protected contents of the package.

In a preferred embodiment, the tray is molded in one mold cavity to produce three parts: a main body, a slidable lock strap and a hinged lock flap. The main body has a shelf portion at one end with a central opening through which a latch extension from the lock flap is positioned. A similar opening near the free end of the cover panel also receives the latch extension. The cover panel is held on top of the shelf by the latch extension, which extends through the cover panel opening and through the opening in the shelf at one end of the main body.

The lock flap is connected to the main body by a living hinge on an upper outward edge of one end of the body. The lock strap is formed within a central opening in the body and is connected to the main body by flexible straps. The lock strap is molded in one position and is moved into an operative position. Extensions from the lock strap and extensions from the main body respectively engage adjacent parts of the main body and of the strap to permit sliding. The flexible straps permit moving the lock flap to an operative position and function as an over-the-center spring mechanism to urge the lock strap into the full locking position. In that full locking position, a lock rib on one end of the lock strap engages the latch extension and prevents opening of the lock flap.

To release the latch extension, a pull ring on an opposite end of the lock strap is moved in a direction away from the locking position. Stops prevent excessive movement in the unlocking direction. Movement of the lock strap to the unlocking position releases the lock flap for opening. The flexible straps return the lock strap to the locking position when the pull ring is released.

After the lock flap has been opened, the free end of the cover panel is lifted. The cover panel is hinged about the far end of the tray. Lifting the free end peels lateral edges of the cover panel from beneath the inward projections on sides of the tray. Opening the cover panel provides access to the contents within the container.

The cover is then returned to the closed position. Pushing downward on a center of the cover panel resiliently bends the cover about a longitudinal axis, permitting edges of the cover panel to snap beneath the inward projections on the upward extended sides of the tray. The lock flap is then closed on the cover. The latch extension rib extends through the opening in the cover and the aligned opening in the shelf portion of the tray. The latch extension rib has a sloped outward surface, which engages a sloped camming surface on the top of the lock rib, pushing the lock rib and the lock strap away from the locking position so that the latch extension rib may snap beneath the lock rib. The flexible straps return the lock strap and the lock rib to the locking position, and the package is secure against unintended opening.

Opening of the package requires movement of the lock strap by sliding the pull ring within the aligned oval openings in the tray and in the base panel of the cover at the same time that the lock flap is raised.

In a preferred form the lock flap is formed with parallel slits extending perpendicularly from positions spaced from the living hinge to the opposite free edge of the lock flap. The slits divide the lock flap into three sections. A central section has an opening through which the latch extension rib is formed. Two outer sections have domed portions which present raised free edges of the outer sections. The raised edges open toward the opposite end of the package. Inserting fingers longitudinally under the raised edges and domed portions while the pull ring on the other side of the container is being moved away from the locking position raises the outer sections of the lock flap. The sliding of the lock strap releases the latch extension rib and permits raising of the central section of the lock flap. The raising of both outer sections of the lock flap causes the raising of the central section of the lock flap and the lifting of the latch extension away from the position of engagement with the lock rib. In one embodiment of the invention, lifting of both outer sections is required to provide sufficient torque in the areas at the end of the slits to lift the central section.

The present invention provides a locking container. A container has a tray and a sliding lock connected to the tray. A lock flap is connected to the tray and cooperates with the sliding lock. A cover, connected to the tray, has a free end positioned under the lock flap when the cover is closed for holding the cover closed when the lock flap is positioned over the free end of the cover. The sliding lock cooperates with the lock flap to hold the lock flap closed.

A preferred container has a tray that has a shelf at one end. The lock flap has a hinged end connected to the shelf. A latch extension rib on the lock flap cooperates with the sliding lock and locks and releases the lock flap.

The lock flap has parallel slits perpendicular to and spaced from the hinged end extending to a free edge of the lock flap. The spacing creates a central section and two outer sections of the lock flap. The free edge of the lock flap has raised finger insertion portions in the outer two sections. The raised finger insertion portions in the outer two sections lift the outer two sections, the central section and the latch extension rib and release the free end of the cover.

The sliding lock extends along the bottom of the tray. A pull ring at one end of the sliding lock moves the sliding lock with respect to the tray. The ledge at an end opposite the pull ring engages the latch extension rib on the lock flap.

The tray has a longitudinal opening. The sliding lock is positioned within the longitudinal opening in the tray. The sliding lock has outward extensions and the tray has inward extensions along the longitudinal opening that hold the sliding lock in the tray.

In a preferred embodiment, the tray, the sliding lock and the lock flap are molded together. The cover has a base connected beneath the tray, a spine extending over one end of the tray remote from the lock flap and a top extending from the spine to the free end of the cover. The laminated top has an inner laminate and has bubbles individually holding products between the top and the tray. The tray has sidewalls. The inward extending ribs of the sidewalls overly side edges of the cover when the cover is closed on the tray.

In a preferred embodiment, the tray is rectangular. The central main body has opposite side walls and opposite end walls. The cover is paperboard or plastic material formed in the three panels with two parallel creases, a base panel for underlying the tray, a spine panel for overlying an end of the tray, and a top panel for overlying a top of the tray. The laminated top panel provides a relatively rigid top cover panel. The elongated opening in the base panel slides the sliding lock. A central opening in the shelf, and a complementary central opening in the top panel near the free end receive the latch extension.

A spring connected between the sliding lock and the tray urges the sliding lock into engagement with the lock flap. The tray, the lock flap, the sliding lock and the spring are molded in one mold cavity.

The present invention is a method for latching and unlatching a container. The tray has an elongated opening, sidewalls and shelf at one longitudinal end. A lock flap hinges to the tray near the shelf. The opening in the shelf, a cover having a base, a spine and a top panel with a free end, connect the base to the tray and overly the tray and the shelf.

A latch extension on the lock flap engages the latching ledge. A spring between the tray and the sliding lock urges the sliding lock and the latching edge into engagement with the latch extension when the top panel is closed and the lock flap is closed on the top panel.

These and further and other objects and features of the invention are apparent in the disclosure, which includes the above and ongoing written specification, with the claims and the drawings.

BRIEF DESCRIPTION OF THE DRAWINGS

FIG. 7 is a cross sectional detail of the package being locked and secured.

FIG. 9 is a bottom of view showing the molded position of the tray.

FIG. at 16 is a similar detail showing the lock strap in a forward, use, locking position.

FIG. at 17 is a top perspective view, which shows the tray with the lock strap and the lock flap in locked positions.

Figure 18:
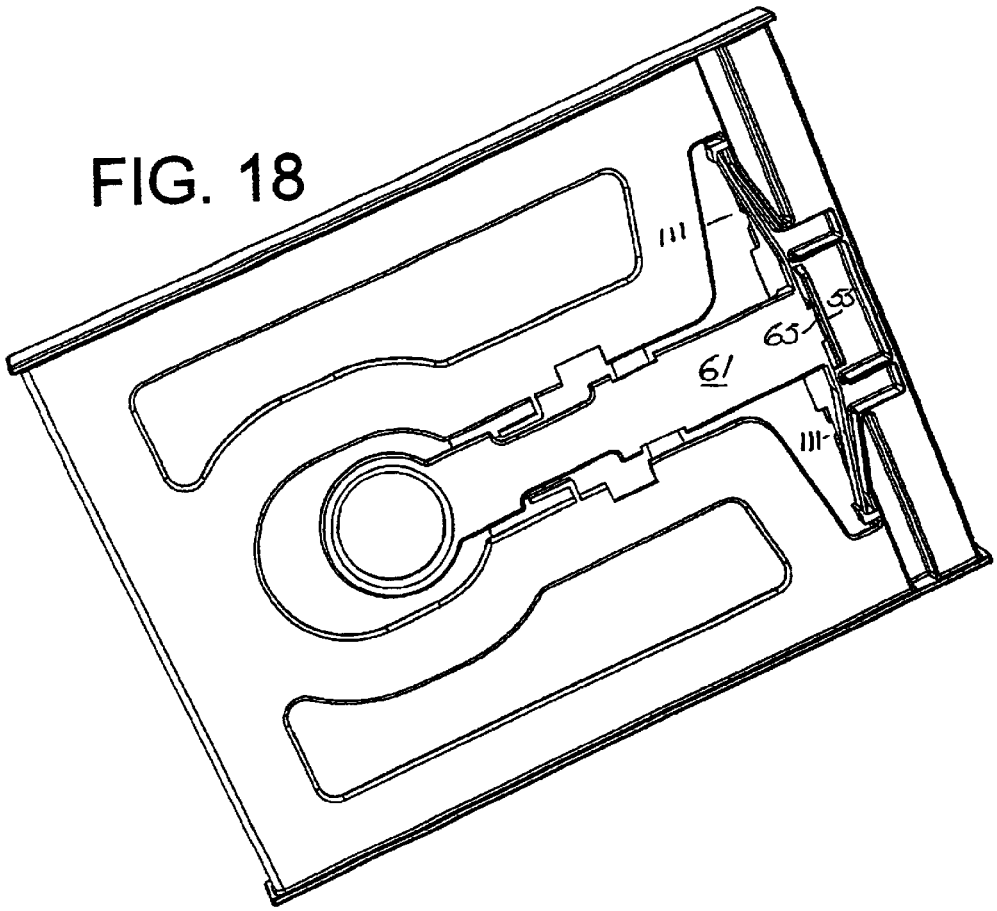

FIG. 18 is a bottom perspective of the tray with the lock strap and lock flap in locked positions.

Figure 19:
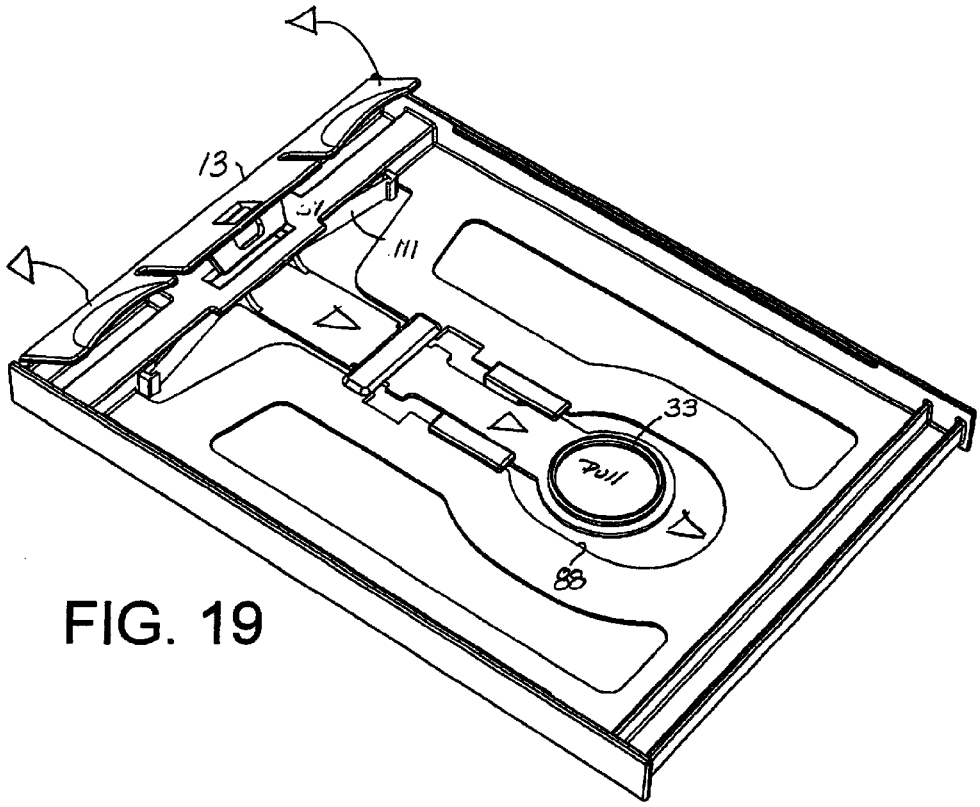

FIG. 19 shows pulling of the pull ring and opening of the lock flap.

Figure 20:
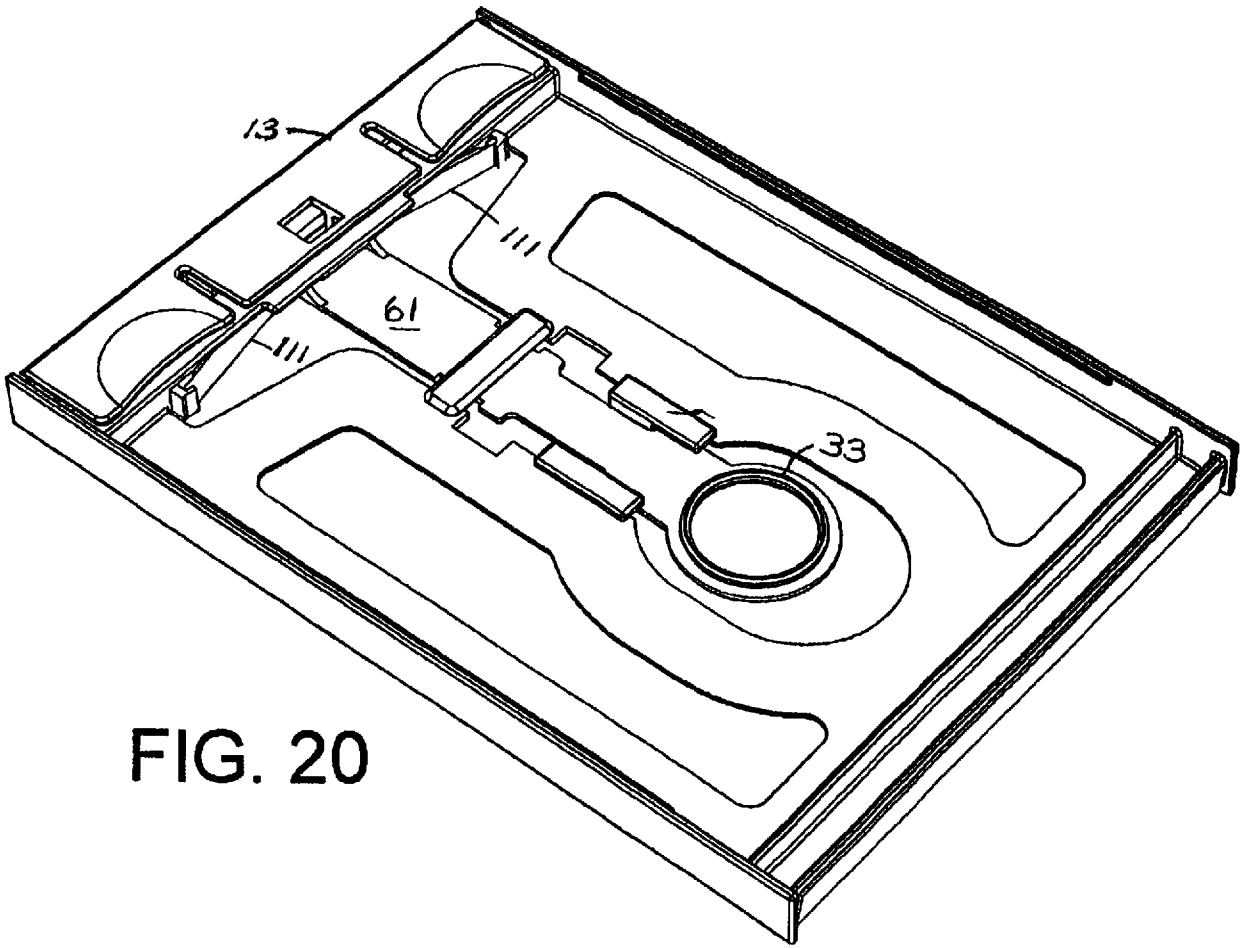

FIG. 20 is a top perspective view of the tray with the flap and strap in locked position.

Figure 21:
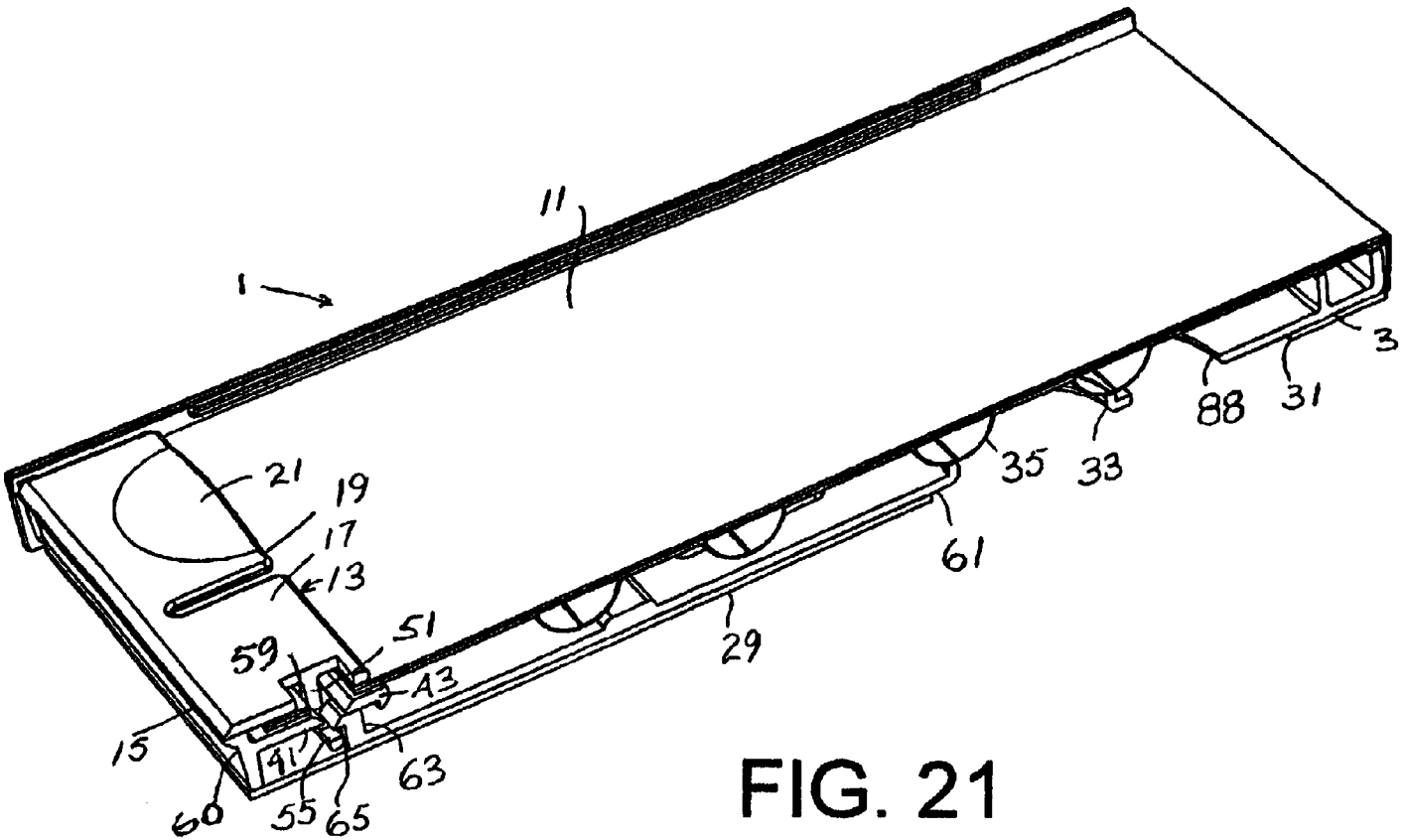

FIG. 21 is a cross sectional perspective view of the container, with the sidewall ribs of the tray extending over the cover panel and the package closed and locked.

Figure 22:
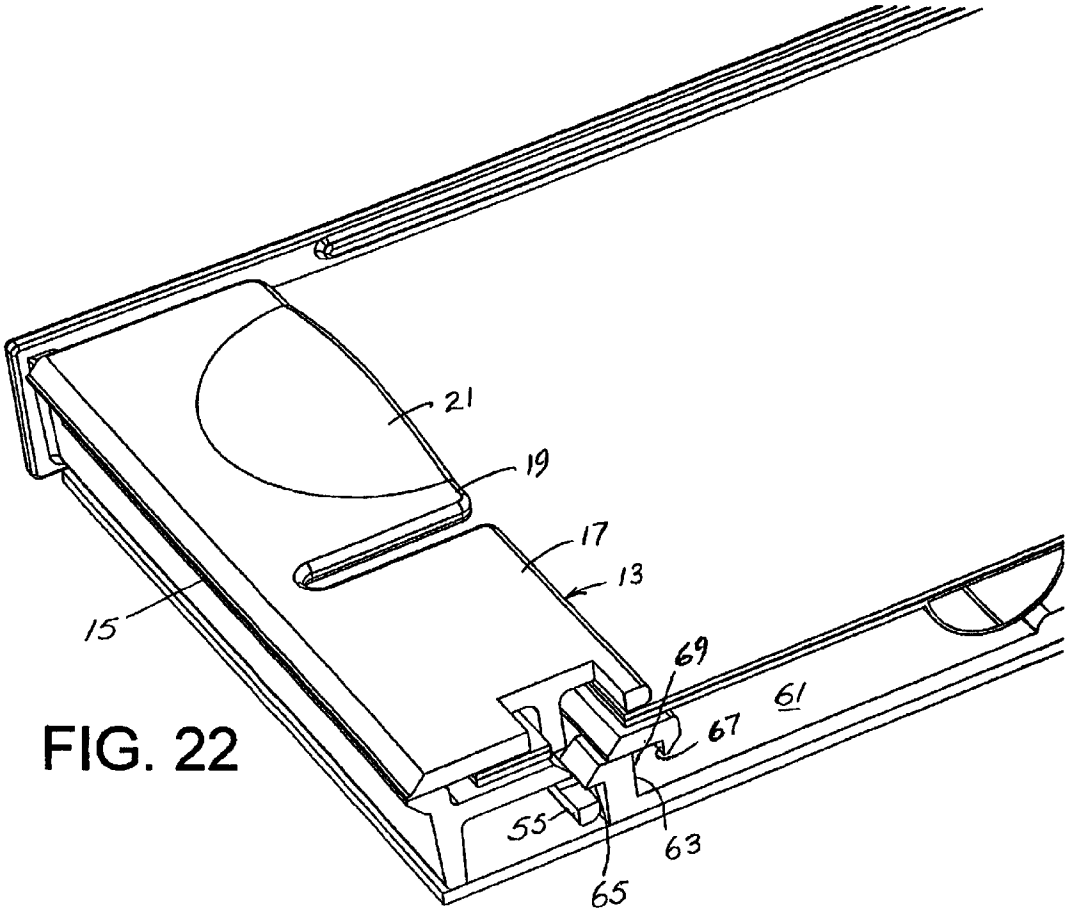

FIG. 22 is a detail of the drawing shown in FIG. 21.

DETAILED DESCRIPTION OF THE PREFERRED EMBODIMENTS

Figure 1:
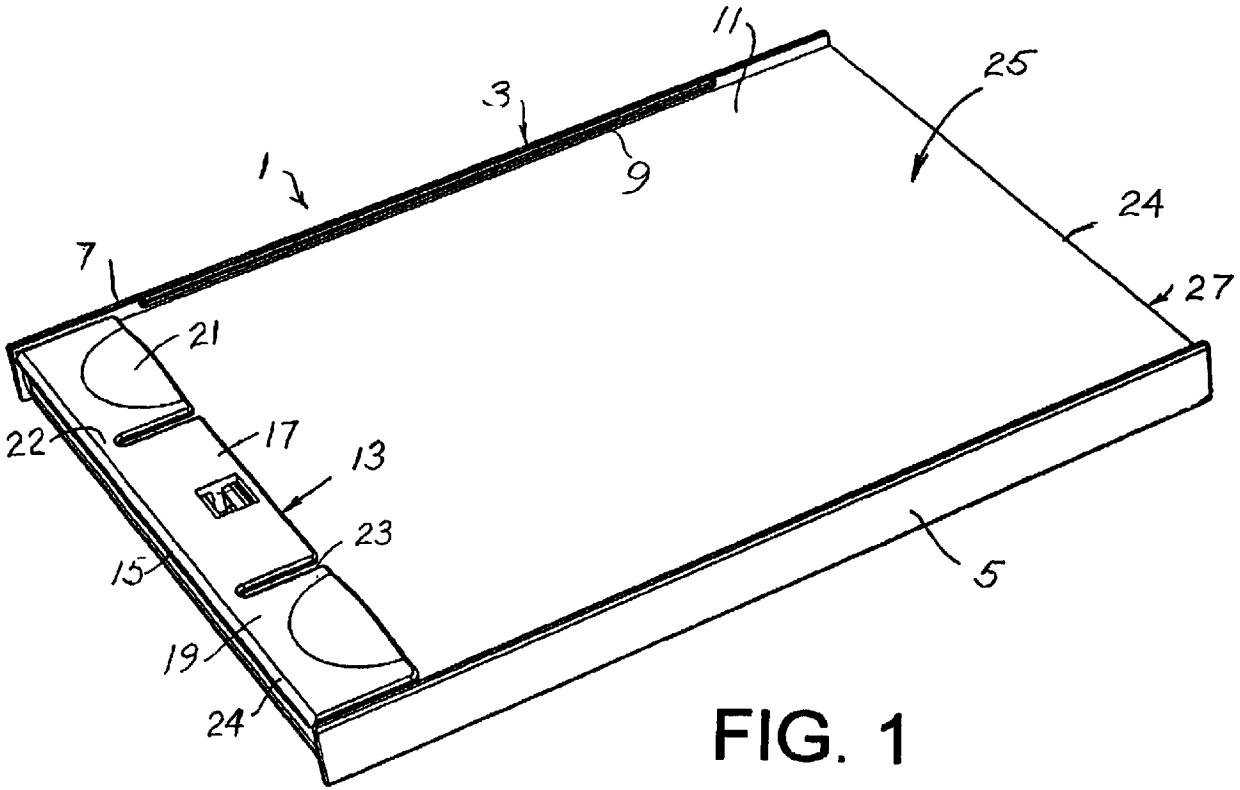
FIG. 1 is a top perspective drawing up of the container.

Referring to FIG. 1, a locking container for holding pills or other objects is generally indicated by the numeral 1. The container has a rectangular molded plastic tray 3 with rectangular opposite lateral sides 5 and 7. Elongated ledges 9 extend inward from upper edges of the sides 5 and 7. The ledges hold down side edges of a cover panel 11. The cover is formed as a rigid section of a creased and folded plastic or paperboard sheet material enclosure 25.

A locking flap 13 holds down one end of the cover panel 11. The locking flap is connected to an upper edge of longitudinal end 14 of the tray 3 by a living hinge 15. The locking flap has an operative center section 17 and two side sections 19. The center section has a latch extension. The side sections have raised curved portions 21, under which tips of two fingers may be inserted for lifting the entire flap 13. The center section 17 and the two side sections 19 are separated by grooves 23. The grooves prevent raising of the center section 17 by lifting only one of the side sections 19.

The grooves are spaced by areas 22 from the edge 24 of the flap 13. Lifting concurrently on both side sections 19 transmits enough force through the connected areas 22 to the center section 17 to rotate the center section upward. Once the center section 17 has been lifted, the cover panel 11 may be rotated upward to expose the contents of the box. By controlling the lengths of slits 23 and the areas 22 the lock flap may be designed so that an area 22 transmits sufficient torque to lift the center section 17 when lifting only one side section 19.

Figure 2:
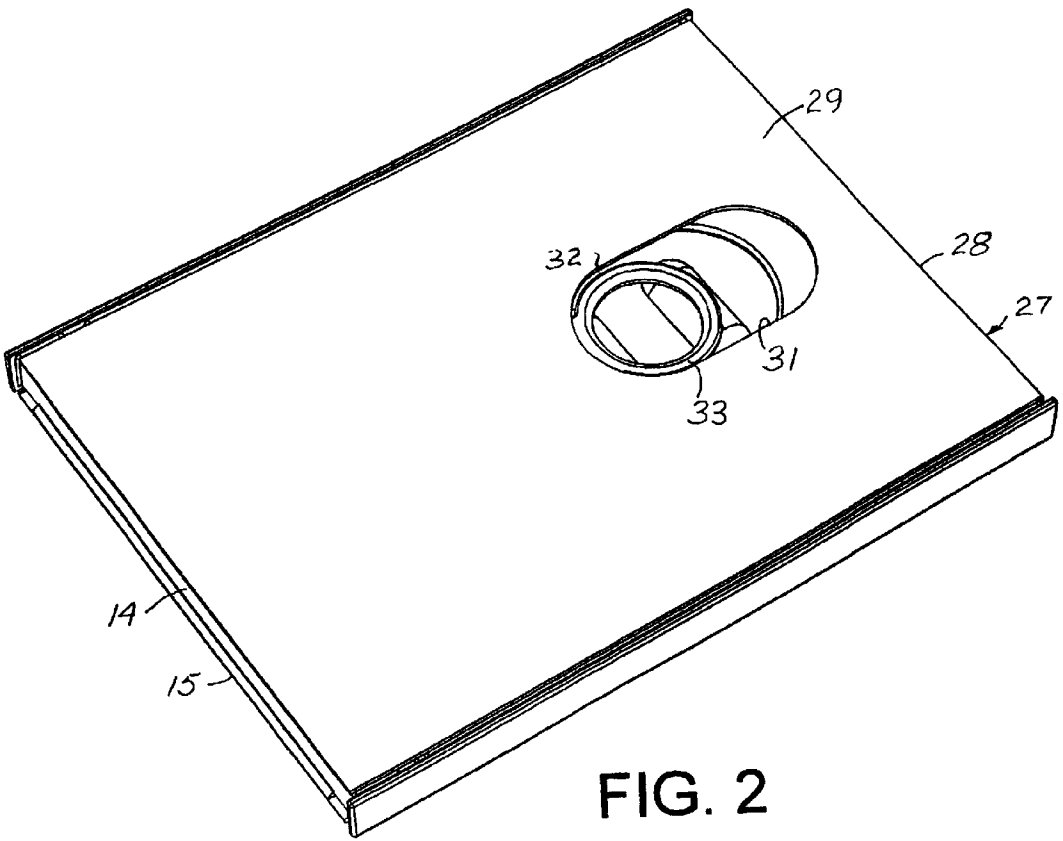
FIG. 2 is a bottom perspective drawing of the container.

In one embodiment as shown in FIGS. 1 and 2, the cover panel 11 is part of a wrap-around sheet material board 25 which surrounds and encloses the top, bottom and one end wall of the tray. The sheet material 25 has a fold 26 at one end of the cover panel 11, which provides an end spine portion 27.

As shown in the bottom perspective view of FIG. 2, the sheet material 25 has a back panel 29 which is connected to the end spine portion 27 along fold 28. The back panel is glued, bonded or otherwise physically attached to the bottom of tray 3. Lateral edges of the back panel 29 are protected by downward extensions of the tray sides 5 and 7. The sheet material board completely covers the top and bottom and one longitudinal end 16 of the tray when the cover is closed.

Alternately the back panel 29 and the cover panel 11 may be made separately. In that embodiment, the back panel 29 is mechanically attached, glued or bonded to the back of the tray 3. The spine portion 27 of the cover is similarly connected to the spine end 16 of the tray, and the cover panel 11 is hinged to the spine portion 27.

An oval cutout 31 is made in the back panel 29. A pull ring 33 is mounted in the tray and is positioned inside of the cutout. The pull ring 33 may be moved from one end of the cutout 31 to the other end. As shown in FIG. 2, the pull ring is in the locked position 32, which prevents flap 13 and cover panel 11 from being opened. In use, the pull ring resides in the locked position unless intentionally moved to an unlocked position.

Figure 3:
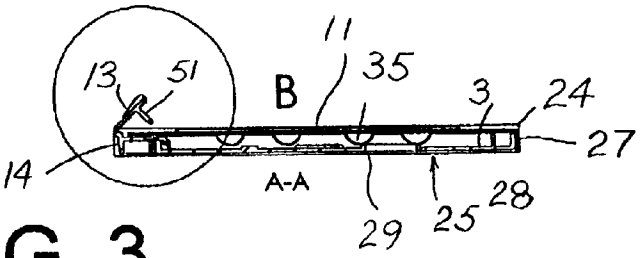
FIG. 3 is a cross section of the container shown in FIGS. 1 and 2.
Figure 4:
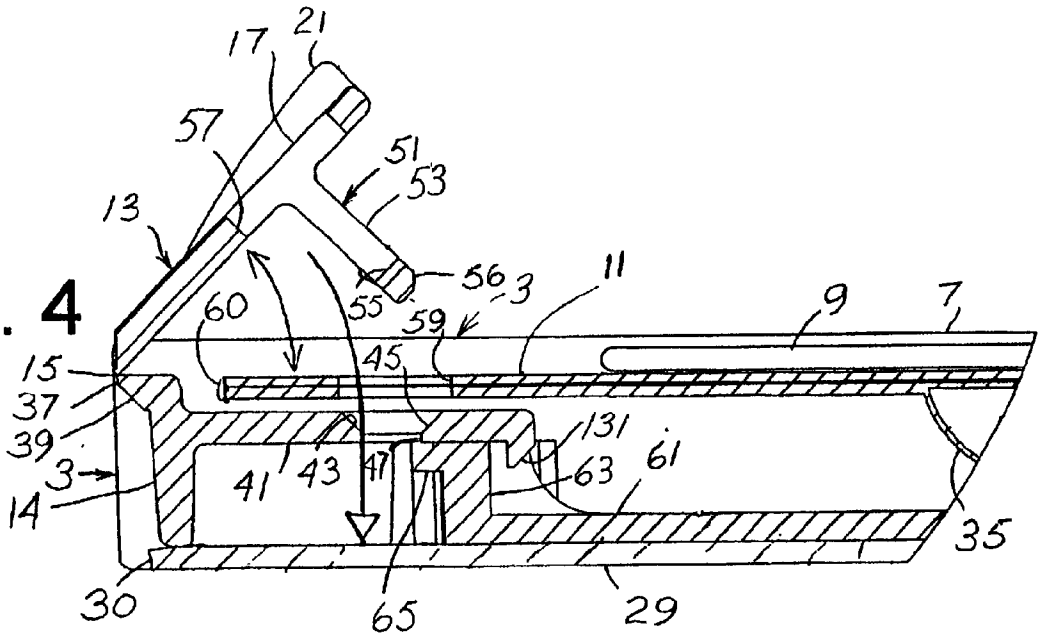
FIG. 4 is a cross sectional detail of the container.

As shown in FIGS. 3 and 4, the lock flap 13 has been raised to permit opening of the cover panel 11. The inside of the cover 11 has multiple pill-holding blisters 35. When the lock flap 13 is lifted, as shown in FIG. 3, the cover 11 may be lifted to provide access to the pill holders 35. The blisters 35, the adjacent wall or junctions are frangible to remove a pill by fracturing one of the blisters, its edges or an abutting area of the cover panel 11.

A cross sectional detail of the lock flap end of the container is shown in FIG. 4. The lock flap 13 is connected with a living hinge 15 to the outer edge 37 of an outward extension 39 along the upper part of end 14 of the tray 3.

As shown in FIG. 4, the tray 3 has a raised shelf 41 along the end 14 of the tray. The shelf has an elongated, rectangular funnel-shaped opening 43 with a sloped guide portion 45 and a narrowed throat 47.

The lock flap 13 has a U-shaped latch extension 51 with side legs 53 which extend perpendicularly from the center section 17 of the lock flap 13. The U-shaped latch extension 51 has a transverse latch rib 55, which extends between ends of the perpendicular legs 53. The latch rib 55 has a sloped surface 56. An opening 57 through which the latch extension 51 is formed is centered in the lock flap 13.

The cover panel 11 has a rectangular cutout 59, which aligns with and overlies the opening 43 in shelf 41 to receive the latch extension 51 when the lock flap 13 is closed over the free end 60 of the cover panel.

To hold the lock flap closed over the free end 60 of the cover panel, the tray 3 has a slidable lock strap 61. A vertical portion 63 at one end of the lock strap supports a lock rib 65. The lock strap 61, its raised portion 63 and the lock rib 65 are movable from left to right as shown in FIG. 4 by moving the pull ring 33 as shown in FIG. 2.

Lock rib 65 locks the latch extension rib 55 when the lock strap and lock rib are in the left position and releases the latch extension rib 55 when the lock strap 61 and lock rib 65 are moved toward the right as shown in FIG. 4. In the locked position the lock rib 65 overlies the transverse latch rib 55, which extends between the two legs 53 of the latch extension 51.

Figure 5:
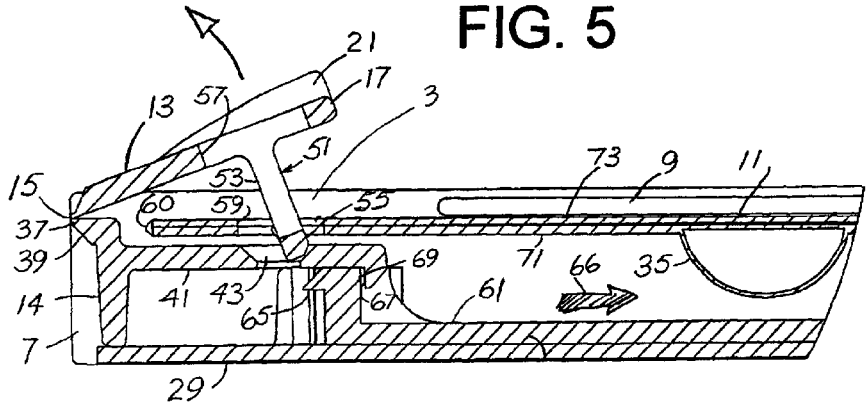
FIG. 5 is a cross sectional a detail of the container showing the lock strap pulled to an unlocked position.

As shown in FIG. 5, the lock strap 61 is moved to the right as shown by arrow 66. The lock rib 65 releases the latch extension rib 55, and the lock flap 13 may be raised.

Shelf 41 has a horizontal projection with a downward extension 67, which stops the surface 69 of the raised portion 63 of the lock strap 61. That prevents excessive withdrawal of the lock strap 61 beyond the unlocked position as shown in FIG. 5.

FIG. 5 also shows the blister 35 formed from an inner layer 71 of the cover panel 11. The inner layer 71 of the cover panel 11 is folded over at free end 60 and is bonded to the outer layer 73 of the cover. FIG. 5 also shows one of the inward extending ledges 9 which overlies edges of the cover and holds the cover panel edges downward until the cover panel is intentionally lifted at free end 60. Lifting the free end 60 peels the cover panel edges from under the ledges 9 as the cover panel is raised. When raising and lowering cover panel 11 the cover assumes a slight curvature or bowing which peels the edges from under the ledges during lifting and snaps edges of the cover past inward ledge extensions 9 when closing the cover panel.

Figure 6:
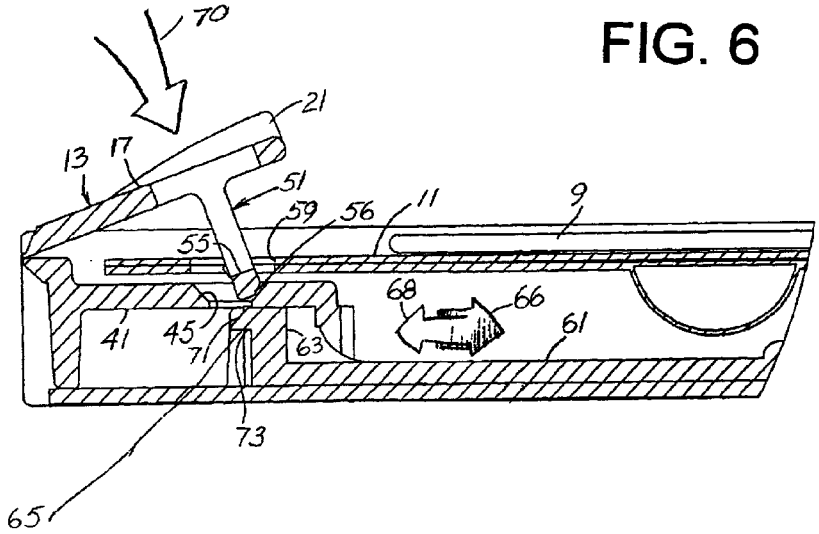
FIG. 6 is a cross sectional detail of the lock flap being closed.

FIG. 6 shows the lock strap moved fully to the left in the direction of arrow 68 so that the lock rib 65 is directly under the opening 43 in the shelf 41. Initially the cover panel 11 is closed by pressing downward on the center of the cover panel to position lateral edges of the cover panel beneath inward extending ledges 9 on the opposite side walls. Then the lock flap 13 is closed by pressing in the direction of arrow 70 on the center section 17 of the lock flap. The sloping surface 56 of the latch rib 55 may engage the sloping surface 45 of the rectangular opening 43 in the shelf 41 to center the latch extension 51. Continued downward force causes the sloping surface 56 to engage the sloping surface 71 on the lock rib 65, which slides the lock rib 65, the raised portion 63 and the lock strap 61 to the right in the direction of arrow 66. This allows the transverse latch rib 55 to snap beneath the lock rib 65 and allows the latch extension 51 to be fully inserted beneath the shelf 41. As soon as the transverse latch rib 55 slides beneath the horizontal surface 73 of the lock rib 65, the lock rib vertical portion 63 and the lock strap 61 are moved to the left in the direction of arrow 68 to lock the latch extension rib 55 and the lock flap 13 in position, securing the cover. The lock strap 61 moves until the latch extension rib 55 is under the lock rib 65.

As shown in FIG. 7, the lock strap 61 and the lock rib 65 are in the locked position. Preferably the return of the lock strap 61 to the locked position is accomplished with a spring. Preferably flexible strap leaf springs are used.

Figure 8:
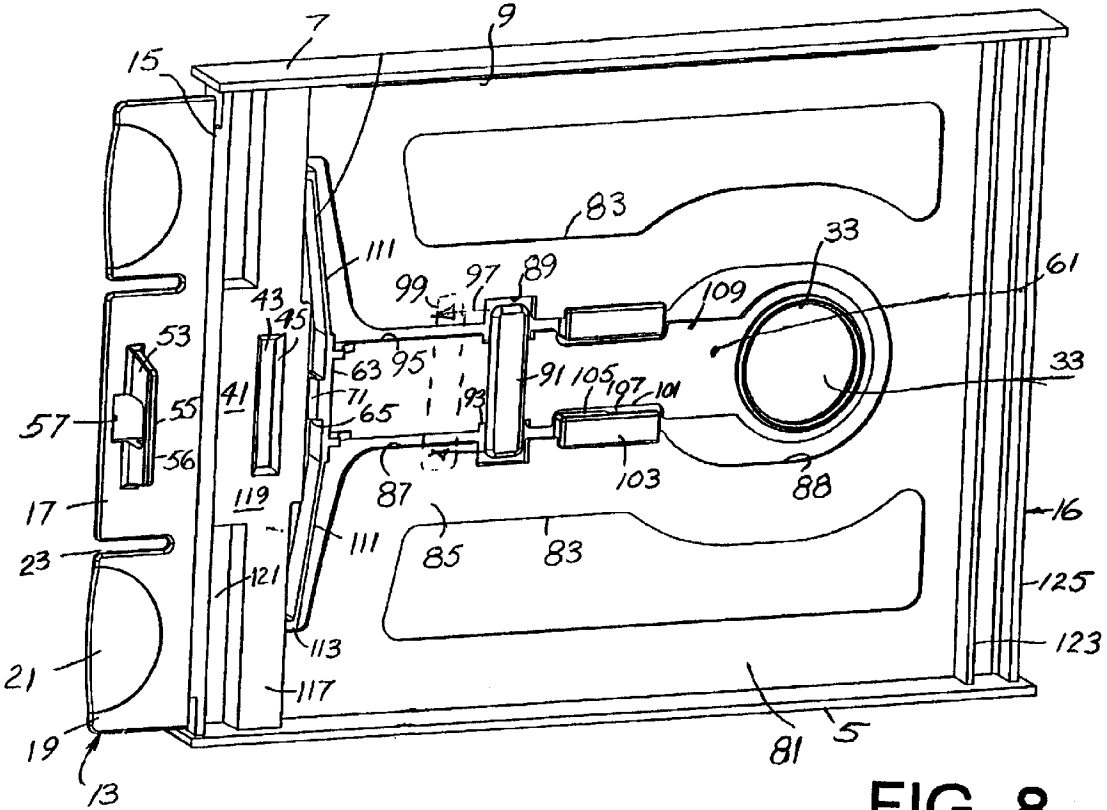
FIG. 8 is a perspective drawing of the main body, lock flap and pull ring.
Figure 10:
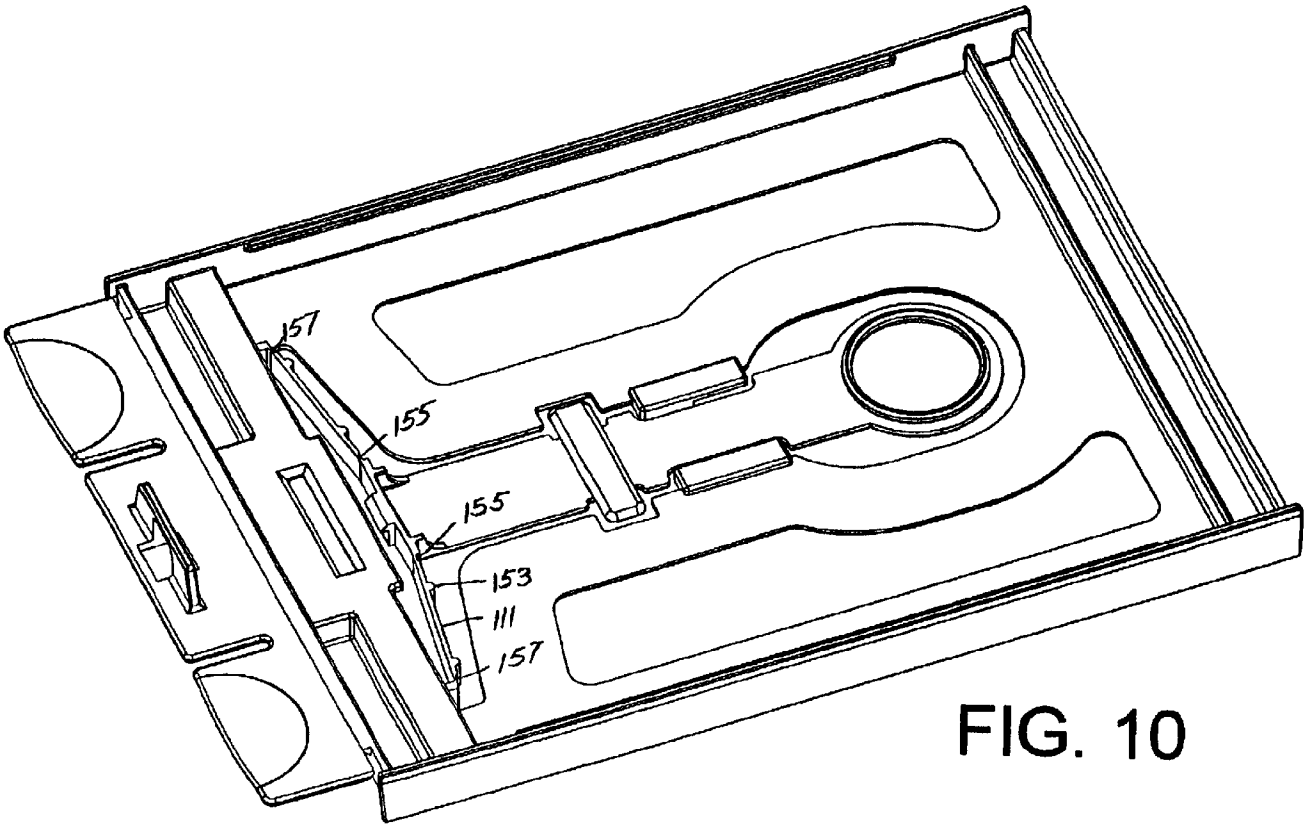
FIG. 10 is a top perspective drawing showing the molded position of the tray.

FIGS.8–10 show the tray 3 in the molded position. The tray 3, the lock flap 13 and the lock strap 61 are formed from plastic in a single mold cavity with limited side actions.

FIG. 8 is a top perspective view. The tray 3 has a main body 81 with material saving and product lightening cutouts 83. Central body sections 85 surround the central inward facing edges 87, the elongated central opening 86 and the oval opening 88. Recesses 89 in the edges 87 permit the forming of a cross bar 91, which is integrally molded with the lock strap 61. Lateral recesses 93 in the lock strap side walls 95 permit sight flexure in the area of cross bar to permit sliding in the direction of the arrows 97 to the locked position 99 of the cross bar 91 shown in phantom lines. Recesses 101 in the sidewalls 95 of the lock strap 61 permit the forming of guides 103. Guides 103 are integrally formed with the central body sections 85. Guides 103 extend inward from the inter walls 87 of the body sections. The guides have thick rims 105 and thin portions 107. The thin portions 107 form surfaces on which lateral areas 109 of the lock strap 61 slide.

The forward end of the lock strap 61 has integrally formed thereon the perpendicular end member 63 with the lock rib 65. The sloped surface 71 of the lock rib is used to facilitate assembly of the lock strap 61 into the use position, as well as to aid in the locking function. The perpendicular end member 63 is connected laterally to flexible straps 111 which have ends 113 connected to the sides 115 of the end structure as shown in FIG. 9.

The shelf 41 has raised lateral sections 117 and a center section 119. Lower end sections 121 of the tray 3 are attached to the front end wall 14. At the opposite end 16 two vertical walls 123 and 125 extend between sidewalls 5 and 7.

After molding the tray 3, pull ring 33 may be used to move the lock strap 61 to the right as shown in the bottom view of FIG. 9. The sloping surface 71 on the lock rib 65 will push against the sloping surface 131 on the protrusion 133 of the central section 119, which forms shelf 41, permitting the lock rib 65 and the vertical section 63 to pass under the protrusion 133 on the shelf. The cooperating surfaces 67 and 69, as shown in FIG. 5, prevent the return of the lock strap beyond the protrusion 133.

When the pull ring 33 slides the lock strap to the right into operational position, lower surfaces 141 of the cross bar 91 slide over upper surfaces of the inner portions 85 of the tray body. The upper lateral surface areas 109 on the lock strap 61 slide under the lower surfaces 143 of the thin portions 107 of extensions 103. The thick rims 105 provide ends 145 to prevent overtravel of the lock strap 61 in the locking direction.

Near the end 14, the shelf portion 41 has vertical walls 147 which support the shelf near the opening 43. Ends 149 may abut the flexible straps 111 and prevent over travel of the lock rib 65 in the locking direction. Sloped walls 151 permit the flexible straps 111 to extend, bend or arc.

FIG. 10 shows a top view of the preferred tray 3 in the molded position. Reinforcing ribs 153 are added to the flexible straps 111, and portions 155 and 157 are thinned near the ends of the straps. The ribs 153 prevent axial warping of the straps, and the ribs and thinned portions 155 and 157 promote controlled bending with reasonable applied forces.

As shown in FIGS. 9 and 10, the edges of the integrally formed tray 3, lock flap 13 and lock strap 61 are radiused to provide additional strength, to prevent tearing and to provide comfort to the user when encountering the exposed surfaces.

Figure 11:
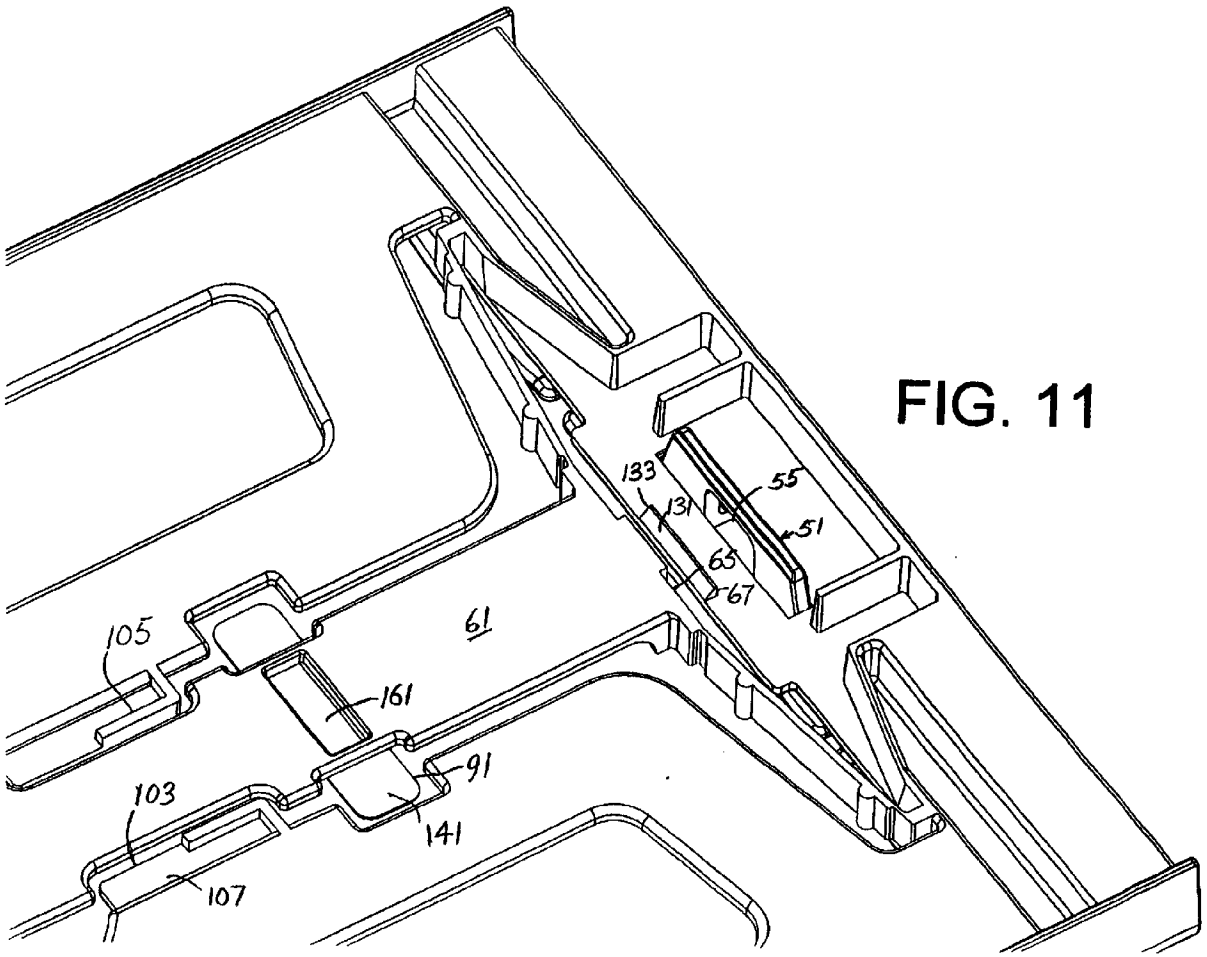
FIG. 11 is a perspective detail showing the lock strap as molded and the lock flap latch extension with the lock flap in the closed position.

FIG. 11 is an enlarged bottom view detail showing the lock flap 13 and the latch extension 51 in the closed position. When the lock strap 61 is moved to the locked position the lock rib 65 prevents opening of the lock flap by engaging the cross rib 55 on the latch extension 51.

FIG. 11, a bottom view, also shows in greater detail the retaining protrusion 133 with the sloping assembly wall 131 and the retaining wall 67. Lock strap 61 has a central recess 161 opposite cross piece 91 to reduce material and weight and to promote flexibility.

Figure 12:
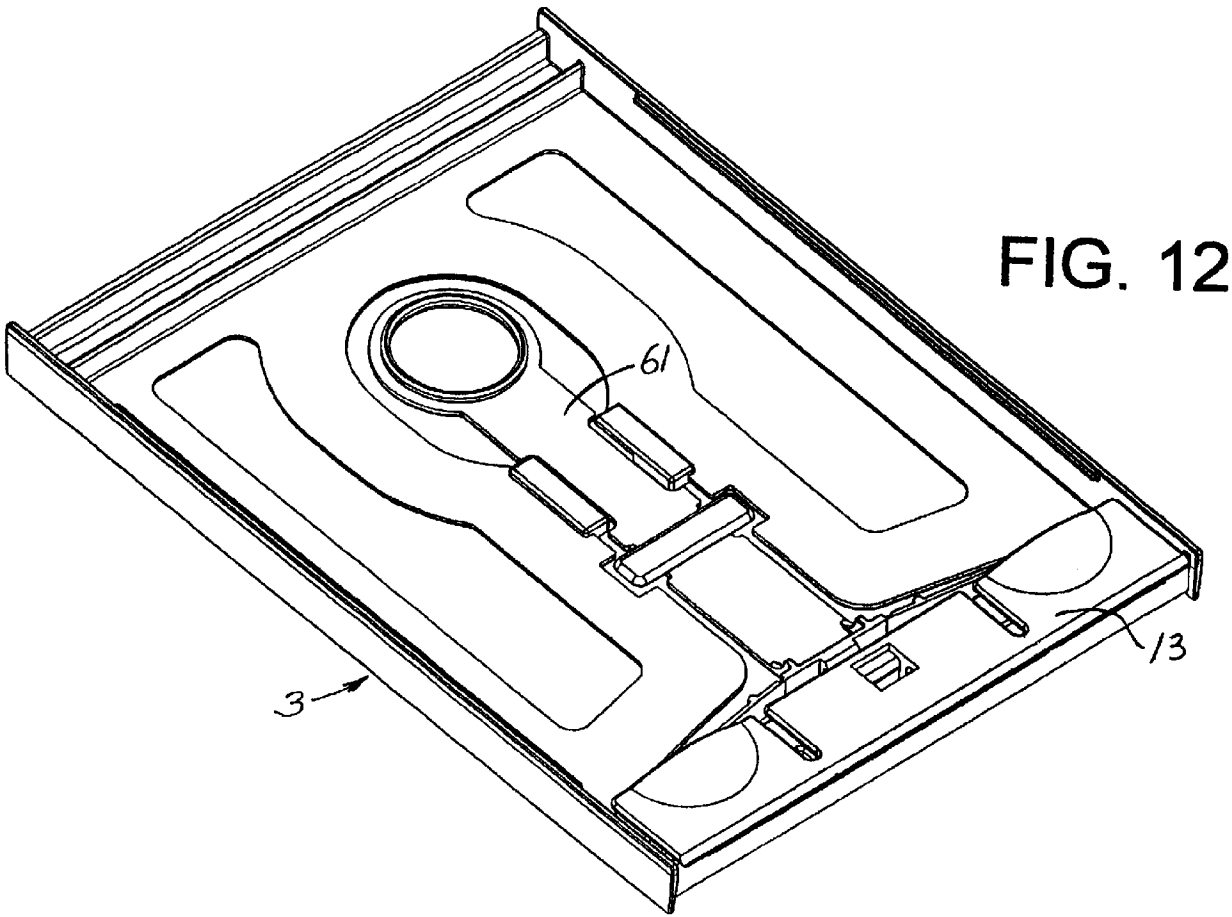
FIG. 12 is a top perspective view of the tray with the lock strap in molded position and the lock flap closed.

FIG. 12 is a top view detail similar to the bottom view detail shown in FIG. 11 with the lock flap 13 closed. The lock flap 13 is divided by slits 23 into outer sections 19 and central section 17. If either of the outer sections 19 on the right or the left of the center section 17 is lifted without lifting the other end section 19, a lifting force is not sufficiently transferred to the center section. That is especially the case if the lock strap has not been retracted. Slits 23 may be shortened so that lifting one side 15 raises the center section.

Figure 13:
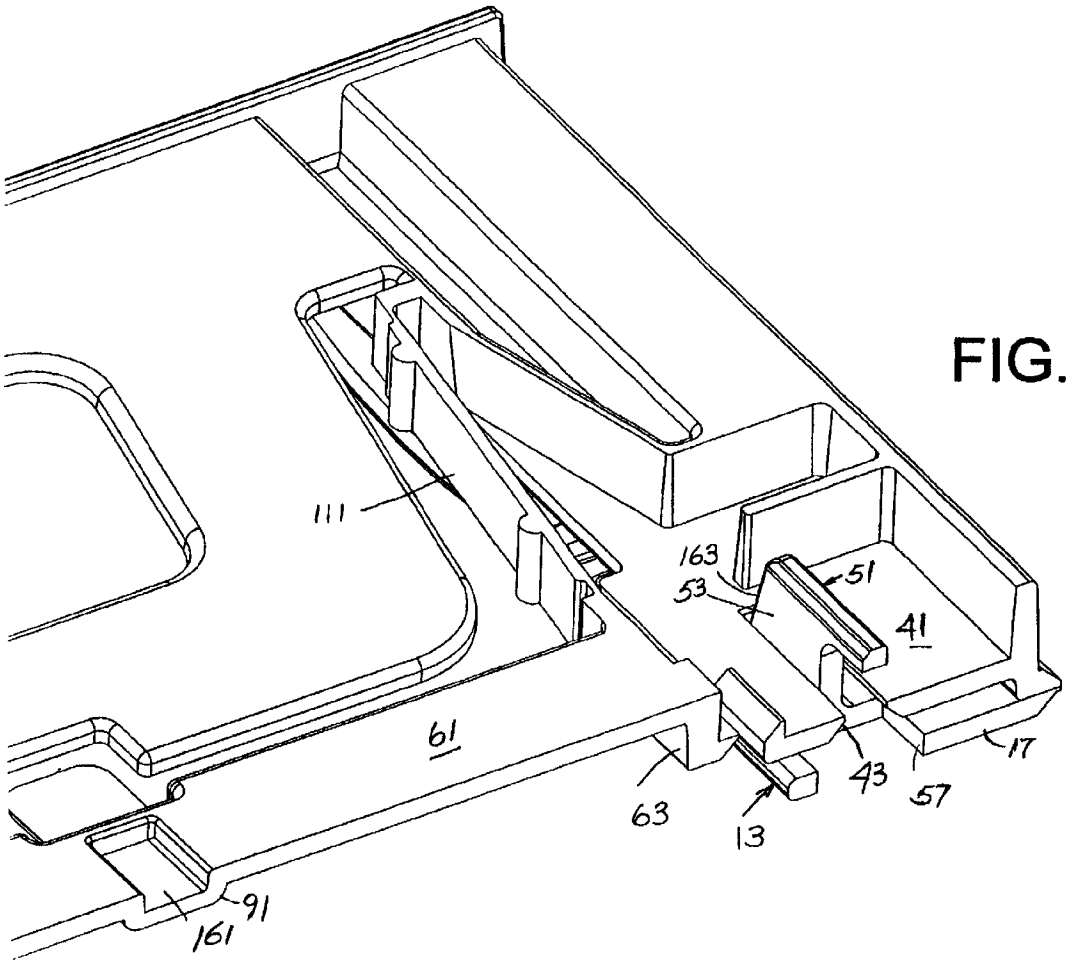
FIG. 13 is a cross sectional bottom perspective detail of the lock strap and the flexible strap spring in molded position and the lock flap closed.

FIG. 13 is a cross sectional bottom view detail similar to FIG. 11, showing the lock flap 13 closed and the latch extension 51 from the center section 17 extending through the opening 43 in the shelf portion 41 of the tray. The lock strap 61 has not yet been slid into operational position.

As shown in FIGS. 11 and 13, the cross member 91 on the lock strap 61 is recessed 161 to provide weight and material reduction while retaining the rigidity of cross member 91. For the same reason, the thick portions 105 are restricted to rims extending around the thin portions 107 of the guides 103 to maintain rigidity of the guides, while reducing material and weight. The legs 53 of the latch extension 51 are relativity wide to provide rigidity and strength in the extension 51. Side edges 163 of legs 53 are tapered to provide strength, lightness and alignment in opening 43.

Figure 14:
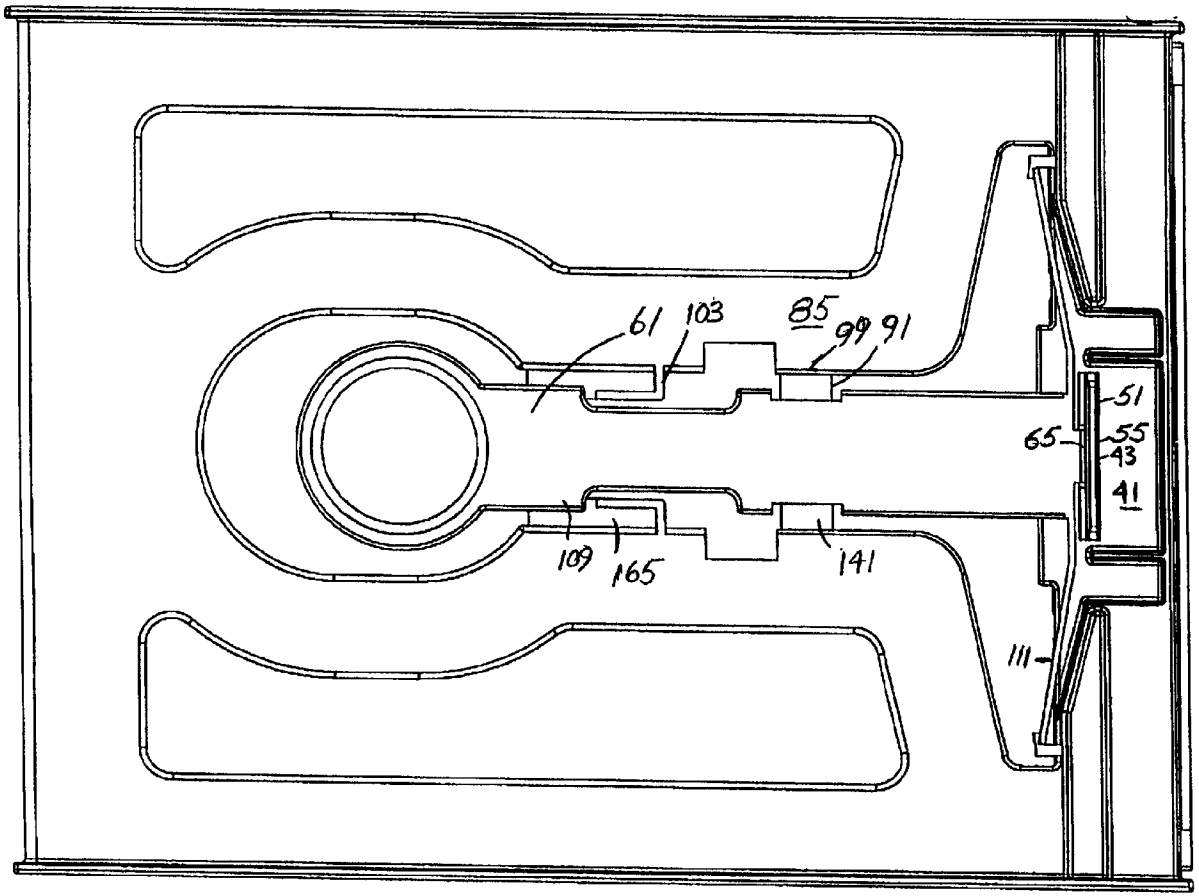
FIG. 14 is a bottom view showing the lock strap in forward locking position holding the lock flap in the closed position.

FIG. 14 shows a bottom view of the tray 3, with the lock flap 13 closed and the latch extension 51 extending through the opening 43 in the shelf 41. The lock strap 61 has been moved into the locking position, in which the lock rib 65 overlies the latch rib 55 of the latch extension 51. The lower surfaces 141 of the cross member 91 have been slid into position 99 on top of the inner portion 85 of the tray body 81. The upper surfaces of the edge portions 109 of lock strap 61 have been slid under the thin portions 107 of the guides 103. The flexible straps 111 have been moved over-the-center to their operative position.

Figure 15:
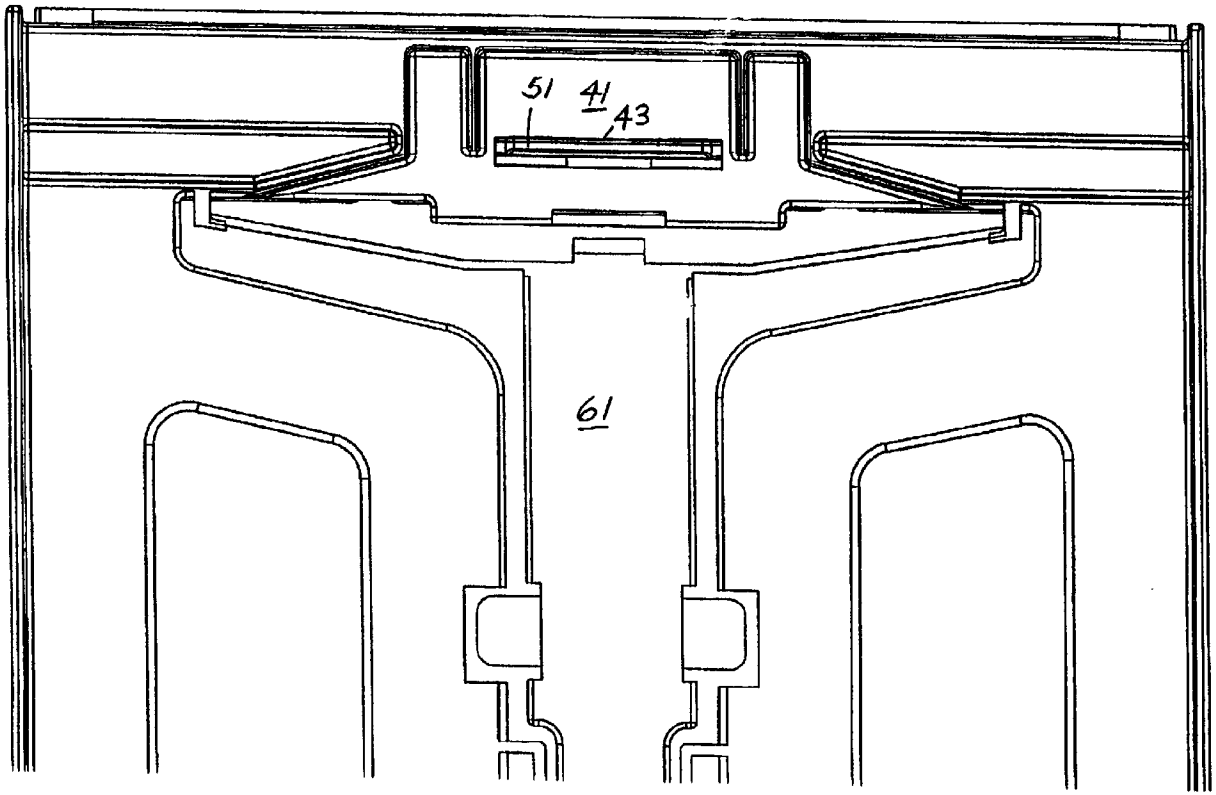
FIG. 15 is a bottom view detail of the tray showing the lock flap in closed position and the lock strap in molded position.
Figure 16:
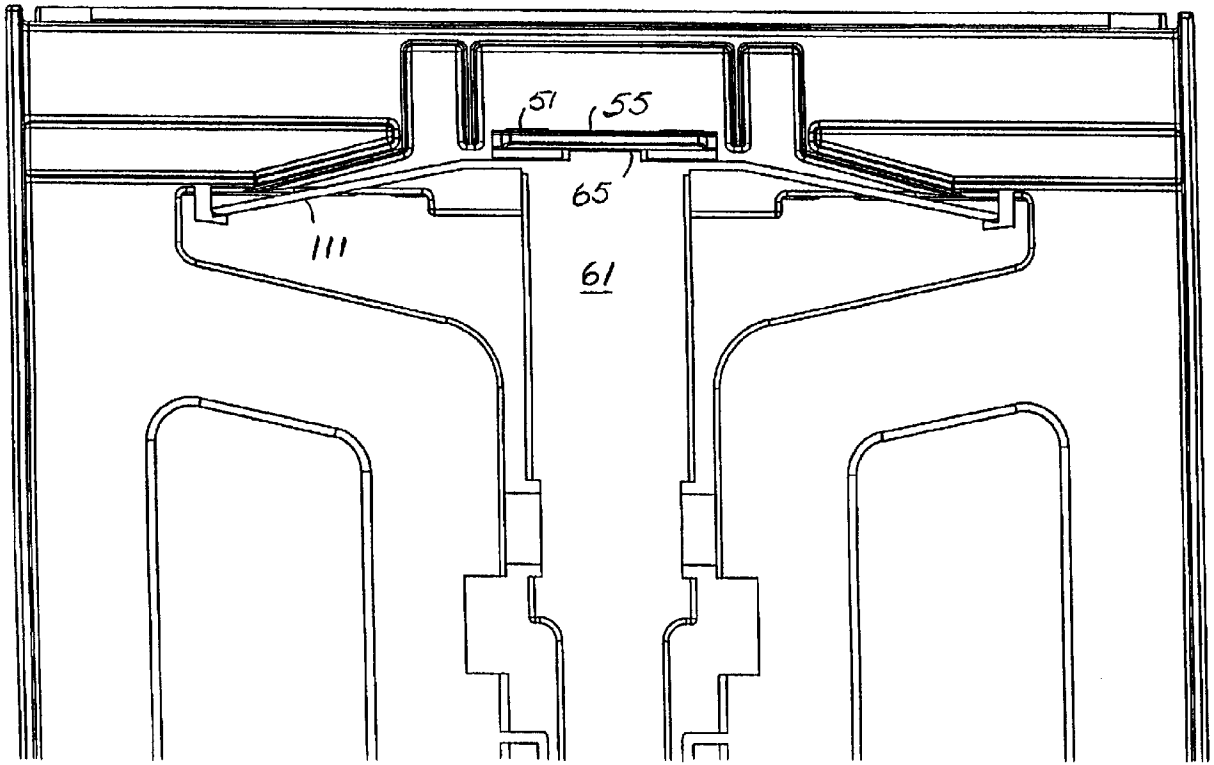

FIGS. 15 and 16 are bottom view details of the tray with the lock flap 13 closed and the latch extension 51 extending through the opening 43. In the detail of FIG. 15, the lock strap 61 is shown in its molded position. In FIG. 16, the detail shows the lock strap 61 in the forward locking or use position.

Figure 17:
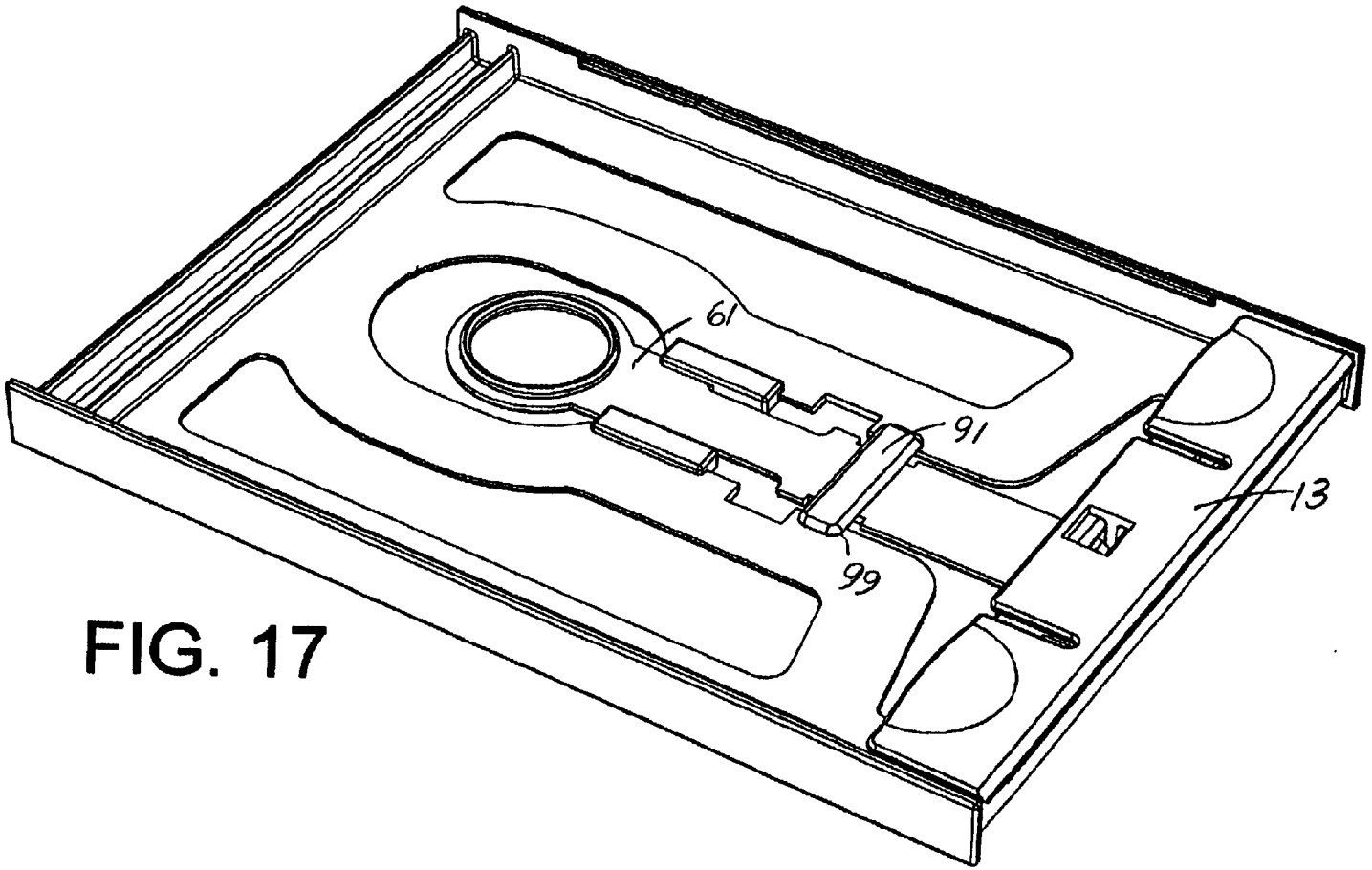

FIGS. 17 and 18 respectively are top and bottom perspective views of the tray 3 with the lock flap 13 in the closed position and the lock strap 61 moved to the operational locking position. The flexible straps 111 hold the lock strap 61 in the locking position and return the lock strap 61 to the locking position, when the pull ring 33 is released after opening the container.

FIG. 19 shows the pull ring 33 moved toward the center of the oval opening 88, disengaging lock rib 65 from the latch extension 51 and releasing the locking flap 13, which has been raised to release a cover panel 11. When the pull ring 33 is released, the flexible straps 111 return the lock strap 61 to the locking position.

FIG. 20 is a top perceptive view of the tray 3 in which the pull ring 33 has been released and the flexible straps 111 have moved lock strap 61 to the locking position. The lock flap 13 has been closed and secured.

FIG. 21 is a perspective longitudinal cross-sectional view of the container, in which the lock flap 13 has been closed on free end 60 of the cover panel 11. The latch extension 51 extends through opening 59 in the cover panel and opening 43 in the shelf 41. The lock rib 65 is positioned above the cross latch rib 55 of the latch extension 51, preventing opening of the lock flap 13 until the pull ring 33 is slid to the right. Pull ring 33 is exposed through the large oval opening 31 in the base panel 29 of the cover and the aligned oval opening 88 in the tray 3. Blisters 35 contain the products, which are held in the locked container.

FIG. 22 is a detail of the lock flap 13 holding the cover panel 11 closed and the lock rib 65 preventing the opening of the lock flap. Stops 67 and 69 prevent overtravel of the lock strap 61 in the unlocking direction.

The pull ring 33 may be operated and the lock flap 13 may be opened by placing thumbs under both longitudinal ends of the container and placing fingers on top of the container. One thumb, for example the right thumb operates the pull ring 33. Index and ring fingers of the other hand, for example the left hand may be curled with tips of those fingers under the domes 21 on the outer sections 19 of the lock flap 13. Once the lock flap 13 has been raised, the ring 33 may be released, and the right hand may be used to raise the cover panel 11. Raising the cover panel by lifting the free end 60 peels edges of the cover panel from under the inward extensions 9. Closing the cover panel by pressing in the middle snaps the edges of the cover panel beneath the side extensions 9.

While the invention has been described with reference to specific embodiments, modifications and variations of the invention may be constructed without departing from the scope of the invention, which is defined in the following claims.

I claim:

1. Locking container apparatus comprising a tray, a sliding lock connected to the tray, a lock flap comprising a latch extension rib for cooperating with the sliding lock, a cover connected to the tray, the cover having a free end positioned under the lock flap when the cover and lock flap are closed, for holding the cover closed when the lock flap is positioned over the free end of the cover and wherein the sliding lock cooperates with the lock flap to hold the lock flap closed.

2. The apparatus of claim 1, wherein the tray has a shelf at one end, and wherein the lock flap has a hinged end connected to the shelf.

3. The apparatus of claim 2, wherein the lock flap has parallel slits perpendicular to and spaced from the hinged end and extending to a free edge of the lock flap, thereby creating a central section and two outer sections of the lock flap, and wherein the free edge of the lock flap has raised finger insertion portions in the outer two sections for lifting the outer two sections and thereby lifting the central section and the latch extension rib for releasing the free end of the cover.

4. The apparatus of claim 1, wherein the sliding lock extends along at a bottom of the tray and has a pull ring at one end of the sliding lock for moving the sliding lock with respect to the tray.

5. The apparatus of claim 4, wherein the sliding the lock has a ledge at an end opposite the pull ring for engaging the latch extension rib on the lock flap.

6. The apparatus of claim 5, wherein the tray has a longitudinal opening, wherein the sliding lock is positioned within the longitudinal opening in the tray, and wherein the sliding lock has outward extensions and the tray has inward extensions along the longitudinal opening for holding the sliding lock in the tray.

7. The apparatus of claim 6, wherein the tray, the sliding lock and the lock flap are molded together.

8. The apparatus of claim 1, wherein the cover has a base connected beneath the tray, a spine extending over one end of the tray remote from the lock flap and a top extending from the spine to the free end of the cover.

9. The apparatus of claim 8, wherein the top is laminated, and an inner laminate of the top has bubbles for individually holding products between the top and the tray.

10. The apparatus of claim 2, wherein the tray has sidewalls and wherein the sidewalls have inward extending ribs for overlying side edges of the cover when the cover is closed on the tray.

11. The apparatus of claim 1, wherein the tray is rectangular and has a central main body, opposite side walls and a opposite end walls, and wherein the cover is paperboard or plastic material which is formed in the three panels by providing two parallel creases, and wherein the three panels comprise a base panel underlying and connected to the tray, a spine panel overlying an end of the tray, and a top panel overlying a top of the tray, and wherein the top panel is laminated for providing a relatively rigid top cover panel.

12. The apparatus of claim 11, further comprising an elongated opening in the base panel for sliding the sliding lock.

13. The apparatus of claim 12, further comprising a central opening in the shelf, and a complementary central opening in the top panel near the free end for receiving the latch extension.

14. The apparatus of claim 1, further comprising a spring connected between the sliding lock and the tray for urging the sliding lock into engagement with the lock flap.

15. The apparatus of claim 14, wherein the tray, the lock flap, the sliding lock and the spring are molded in one mold cavity.

16. A locking container apparatus comprising a rectangular tray having a central body and longitudinally extending sidewalls at lateral edges of the body and having a shelf with a central opening near one end of the central body, a lock flap hinged at one end of the shelf, a latch extension on the lock flap for extending through the central opening, a sliding lock strap positioned in the central body and having a latch rib for cooperating with the latch extension to hold the latch extension and the lock flap closed when the latch rib is engaged with the latch extension, a cover connected to the tray, the cover having two parallel creases dividing the cover into three panels, a base panel underlying and attached to the tray, a spine panel overlying one end of the tray opposite the shelf, and a top panel overlying the tray and the shelf and having a free end and a central opening near the free-end aligned with and cooperating with the central opening in the shelf for receiving the latch extension, for holding the free end under the lock flap, the top panel and the central body and sidewalls of the tray forming a cavity for holding articles, the base panel having an elongated opening for sliding the lock strap and for moving the latch rib and releasing the latch extension and the lock flap to release the top panel for lifting the top panel and exposing the cavity.

17. The apparatus of claim 16, further comprising an inner laminate on the top panel, and wherein the inner laminate has bubbles for holding individual products on an inside of the top panel.

18. The apparatus of claim 16, wherein the elongated opening is in the base panel near the spine panel.

19. The apparatus of claim 16, wherein the side walls have inward extending ribs for overlying side edges of the top panel when the top panel is closed on the tray.

20. The apparatus of claim 16, further comprising a spring connected between the lock strap and the tray for urging the lock strap into engagement with the latch extension.

21. The apparatus of claim 20, wherein the tray, the lock flap, the lock strap and the spring are molded in one mold cavity.

22. Locking container apparatus comprising a tray, a lock connected to the tray, a lock flap connected by a hinged end to the tray and cooperating with the lock, a cover connected to the tray, the cover having a free end positioned under the lock flap when the cover is closed, for holding the cover closed when the lock flap is positioned over the free end of the cover and wherein the lock cooperates with the lock flap to hold the lock flap closed and wherein the lock flap has parallel slits perpendicular to and spaced from the hinged end and extending to a free edge of the lock flap, thereby creating a central section and two outer sections of the lock flap, and wherein the free edge of the lock flap has raised finger insertion portions in the outer two sections for lifting the outer two sections and thereby lifting the central section for releasing the free end of the cover.

23. The apparatus of claim 22, wherein the tray has a shelf at one end and wherein the lock flap hinged end is connected to the shelf.

24. The apparatus of claim 22, wherein the lock flap further comprises a latch extension rib for cooperating with the lock for locking and releasing the lock flap.

25. The apparatus of claim 22, wherein the lock extends along at a bottom of the tray and has a pull ring for moving the lock with respect to the tray.

26. The apparatus of claim 24, wherein the lock has a ledge opposite the pull ring for engaging the latch extension rib on the lock flap.

27. The apparatus of claim 22, wherein the tray has a longitudinal opening, and the lock is a sliding lock strap positioned within the longitudinal opening in the tray, and wherein the sliding lock strap has outward extensions and the tray has inward extensions along the longitudinal opening for holding the sliding lock strap in the tray.

28. The apparatus of claim 22, wherein the tray, the lock and the lock flap are molded together.

29. The apparatus of claim 22, wherein the cover has a base connected to the tray, a spine extending over one end of the tray remote from the lock flap and a top extending from the spine to the free end of the cover.

30. The apparatus of claim 29, wherein top is laminated and an inner laminate of the top has bubbles for individually holding products between the top and the tray.

31. The method of latching and unlatching a container apparatus comprising providing a tray having an elongated opening, in a bottom and having side walls and a shelf at one longitudinal end, hinging a hinged end of a lock flap to the tray near the shelf, providing a shelf opening in the shelf, providing a cover having a base, a spine and a top panel with a free end, connecting the base to the tray, overlying the tray and the shelf with the top panel providing in the top panel near the free end a top paned opening aligned and complementary with the shelf opening, providing a sliding lock in the elongated opening in the bottom of the tray, providing a handle on one end of the sliding lock and a latching ledge on an opposite end of the lock, providing an elongated opening in the base shorter than but aligned and complementary with the elongated opening in the tray bottom for moving the handle, providing a latch extension on the lock flap for engaging the latching ledge, providing a spring between the tray and the sliding lock and urging the sliding lock and the latching edge into engagement with the latch extension when the top panel is closed and the lock flap is closed on the top panel.

32. The method of claim 31, comprising providing parallel slits on the lock flap perpendicular to and spaced from the hinged end and extending to a free edge of the lock flap for creating a central section and two outer sections of the lock flap, providing the latch extension on the outer section, providing raised finger insertion portions in the outer two sections of the free edge of the lock flap for lifting the outer two sections, thereby providing lifting of the central section and the latch extension rib for releasing the free end of the cover, wherein the handle is moved to move the sliding lock and the latching ledge against force of the spring and away from contact with the latch extension rib.

33. The method of claim 32, further comprising holding articles in bubbles attached to an inside of the top panel.

34. The method of claim 31, further comprising providing inward extending ribs on the sidewalls and holding edges of the top panel beneath the inward extending ribs.

35. The method of claim 31, further comprising molding the tray, the shelf, the sidewalls, the sliding lock and the spring in a single mold cavity.

36. The method of claim 35, further comprising moving the sliding lock and the spring into an operative position in the tray after the molding.

37. The method of claim 31, wherein the handle is moved and the lock flap is lifted to open the top panel.

* * * * *